US007336231B2

(12) United States Patent
Hayashi et al.

(10) Patent No.: US 7,336,231 B2
(45) Date of Patent: Feb. 26, 2008

(54) VEHICLE ROOF ANTENNA MOUNTING ASSEMBLY

(75) Inventors: Makoto Hayashi, Tokyo (JP); Toshiro Yokoyama, Tokyo (JP); Jinsong Wang, Tokyo (JP)

(73) Assignee: Harada Industry Co., Ltd., Tokyo (JP)

( * ) Notice: Subject to any disclaimer, the term of this patent is extended or adjusted under 35 U.S.C. 154(b) by 0 days.

(21) Appl. No.: 11/374,561

(22) Filed: Mar. 13, 2006

(65) Prior Publication Data

US 2006/0214860 A1 Sep. 28, 2006

(30) Foreign Application Priority Data

Mar. 14, 2005 (JP) ..... 2005-071528

(51) Int. Cl.
*H01Q 1/32* (2006.01)

(52) U.S. Cl. ..... 343/713; 343/711

(58) Field of Classification Search ..... 343/713, 343/711, 878

See application file for complete search history.

(56) References Cited

U.S. PATENT DOCUMENTS 6,714,171 B2 * 3/2004 Haussler et al. ..... 343/888
7,004,666 B2 * 2/2006 Kozlovski ..... 403/252
2003/0068198 A1 4/2003 Kozlovski
2004/0183734 A1 9/2004 Noro

FOREIGN PATENT DOCUMENTS

| | | |
|---|---|---|
| DE | WO00/35045 | 6/2000 |
| JP | 2001-036315 | 2/2001 |
| JP | 2004-282549 | 10/2004 |

* cited by examiner

*Primary Examiner*—Hoang V. Nguyen
(74) *Attorney, Agent, or Firm*—McGlew and Tuttle, P.C.

(57) ABSTRACT

The vehicle roof antenna mounting assembly comprises a convex portion (120), a bolt (160) and a leg washer (140). The convex portion is inserted into a mounting hole (RH) of a vehicle roof panel (R) and has a edge portion (125) and a inner threaded hole (126). The bolt has a screw screwed to the threaded hole and is tightened to the convex portion. The leg washer has a plate washer ring (141), a leg portion (142) and a taper portion (144). The leg portion is extendedly provided from the washer ring toward the mounting hole. The taper portion is provided on the leg portion as opposed to the edge portion and abutted on the edge portion to expand the tip portion toward an outside of the mounting hole.

20 Claims, 5 Drawing Sheets

VEHICLE ROOF ANTENNA MOUNTING ASSEMBLY

RELATED APPLICATION

This application relates to and claims a priority from corresponding Japanese Patent Application No. 2005-071528 filed on Mar. 14, 2005.

BACKGROUND OF THE INVENTION

1. Field of the Invention

The present invention relates to a vehicle roof antenna mounting assembly, and more particularly to a vehicle roof antenna mounting assembly in which operability for mounting it to a vehicle roof panel is taken into consideration.

2. Description of the Related Art

A conventional general vehicle roof antenna mounting assembly is that an antenna base plate is fixed by fitting a convex portion formed on an undersurface of the antenna base plate into a perforated portion formed on a vehicle roof panel and screwing with a nut, etc. from a vehicle interior. This is disclosed in, for example, Japanese Patent Application Kokai Publication No. 2001-036315. Also, as disclosed in Japanese Patent Application Kokai Publication No. 2004-282549, there is one in which a washer with a temporary joint function is previously attached to a convex portion.

The conventional vehicle roof antenna mounting assemblies described above, however, have some problems as follows. That is, since the antenna base plate and the nut for tightening are separated, and it is necessary to screw the nut to the convex portion through the roof panel from the vehicle interior, there is a possibility that, for example, the nut falls out undesirably when the mounting assembly is mounted. Therefore, the conventional mounting assemblies have extremely low operability for mounting it to the roof panel, and force operators to bear the burden.

An object of the present invention, therefore, is to overcome the problems existing in the prior art, and to provide a vehicle roof antenna mounting assembly which can easily be mounted to a vehicle, and in which an operator's burden can be reduced.

SUMMARY OF THE INVENTION

According to one aspect of the invention, there is provided a vehicle roof antenna mounting assembly fixed by inserting a part of the mounting assembly from an outside of a vehicle through a mounting hole formed through a vehicle roof panel so as to catch the vehicle roof panel, the mounting assembly comprising: an antenna base disposed on an outside of the vehicle roof panel of the vehicle; a convex portion formed on a surface of the vehicle roof panel side of the antenna base, inserted into the mounting hole, and having a surface portion surrounding a first screw and a peripheral portion thereof, the surface portion having an edge portion; a tightening member having a second screw screwed with the first screw, and tightened to the convex portion; a leg washer having a plate washer ring through which one of the first screw and the second screw is passed, a leg portion extendedly provided from the washer ring toward the mounting hole, and a taper portion provided on the leg portion as opposed to the edge portion of the surface portion, the taper portion being abutted on the edge portion to expand the tip portion toward an outside of the mounting hole in accordance with which the washer ring is come close to the mounting hole by tightening the tightening member.

The leg portion may be formed flatly, and the taper portion may be extendedly provided on a side of the leg portion.

The taper portion may be formed by bending at least a part of said leg portion inwardly.

The taper portion may be formed to be released from abutting on the edge portion in a condition where the tightening member is completely tightened to the convex portion.

The tip portion may be bended to be abutted perpendicularly on the vehicle roof panel in a condition where the tightening member is completely tightened to the convex portion.

The vehicle roof antenna mounting assembly may further comprise a temporary joint member provided between the convex portion and the leg washer, the temporary joint member comprising: a sandwiched support member sandwiched between the convex portion and the washer ring; an elastic temporary joint leg having a toe portion and an arm portion, and extendedly provided from the sandwiched support member toward the mounting hole, the toe portion being disposed on the outside of the vehicle roof panel in a condition where the vehicle roof antenna mounting assembly is mounted; and a fastening portion formed such that at least a part between the toe portion and the arm portion is disposed on the outside of the mounting hole on an inside of the vehicle roof panel.

According to the invention, since the vehicle roof antenna mounting assembly can be mounted by an extremely easy operation in which the protruding tightening member such as a bolt is only tightened from the vehicle interior, operator's burden can greatly be reduced.

BRIEF DESCRIPTION OF THE DRAWINGS

The above and other objects, features and advantages of the present invention will be apparent from the following description of preferred embodiments of the invention explained with reference to the accompanying drawings, in which.

PREFERRED EMBODIMENTS OF THE INVENTION

Figure 1:
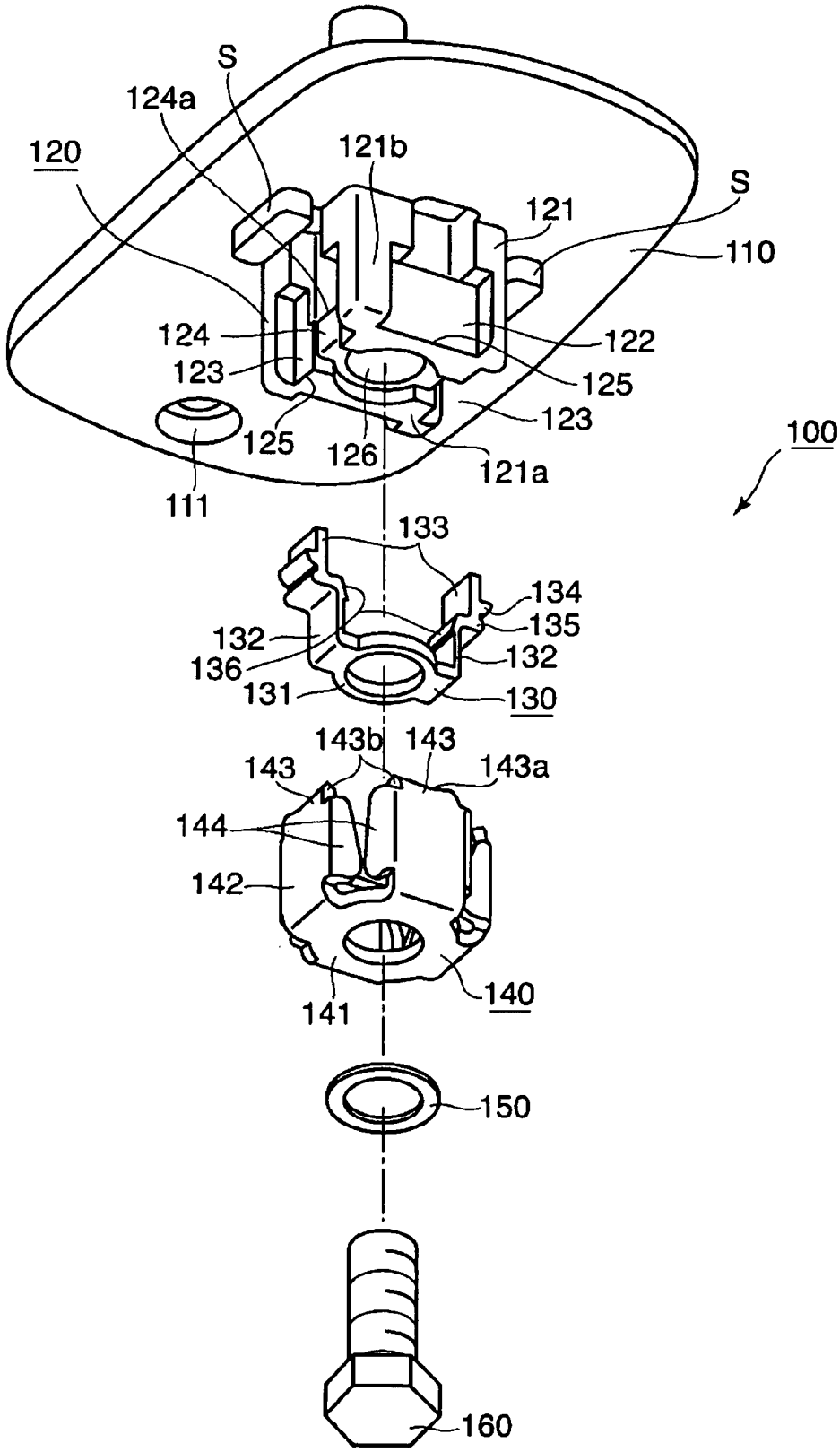
FIG. 1 is an exploded perspective view showing a vehicle roof antenna mounting assembly according to an embodiment of the invention.

Now, an embodiment according to the invention is explained with reference to the drawings. FIG. 1 shows a vehicle roof antenna mounting assembly 100 according to a first embodiment of the present invention. This figure is an exploded perspective view showing components needed for mounting the mounting assembly to a vehicle roof panel R through a mounting hole RH to be described hereinafter. In FIG. 1, a symbol S depicts a position of the mounting assembly to be abutted on the vehicle roof panel.

The vehicle roof antenna mounting assembly 100 includes an antenna base 110, a convex portion 120, a temporary joint member 130, a leg washer 140, a plate washer 150, and a bolt 160. The antenna base 110 is disposed on an upper side of the vehicle roof panel R. The convex portion 120 is formed integrally on a bottom surface of the antenna base 110. The temporary joint member 130 is attached to the convex portion 120. The leg washer 140 having leg portions 142 is made of metal and tightened to the convex portion 120. The bolt 160, i.e., a tightening member or a second screw tightens the leg washer 140 and the plate washer 150 to the convex portion 120.

An antenna mast not shown is attached to the antenna base 110. The antenna base 110 has an opening 111 for passing a kind of cable therethrough.

The convex portion 120 has a convex body 121 of a quadrangular cylinder shape. A bottom surface 121*a*, i.e., a surface portion of the convex body 121 is parallel to the vehicle roof panel R, and sidewall surfaces 121*b* are perpendicular to the vehicle roof panel R. The sidewall surfaces 121*b* have two pairs of notches 122, 122, 123, 123. Each of the notches 123, 123 also has other notches 124, 124, and a step 124*a* which is hooked on a latch 136 to be described hereinafter. There are edge portions 125 each at an intersection between the bottom surface 121*a* and the bottom of the notches 122, 122, 123, 123. An internal threaded hole 126, i.e., a first screw is formed on a central axis of the convex portion 120.

The temporary joint member 130 is made of resin, metal, etc. having elasticity. The temporary joint member 130 has a ring body 131, i.e., a sandwiched support member which is fitted into a top of the convex portion 120, and a pair of joint legs 132 which is extendedly provided as opposed to each other from the ring body 131. The joint legs 132 are formed to fit into the notches 124 described above. A toe portion 133 of each of the joint leg is formed to abut on an inner face of the mounting hole RH. A fastening portion 134 and a release knob 135 larger in diameter than the mounting hole RH are formed on a part of each of the joint legs 132. The latch 136 is formed on an inner face of each of the joint legs 132 and hooked on the step 124*a* described above. Therefore, it can be prevented that the temporary joint member 130 falls off from the convex portion 120, so that the operability can be improved.

Figure 2:
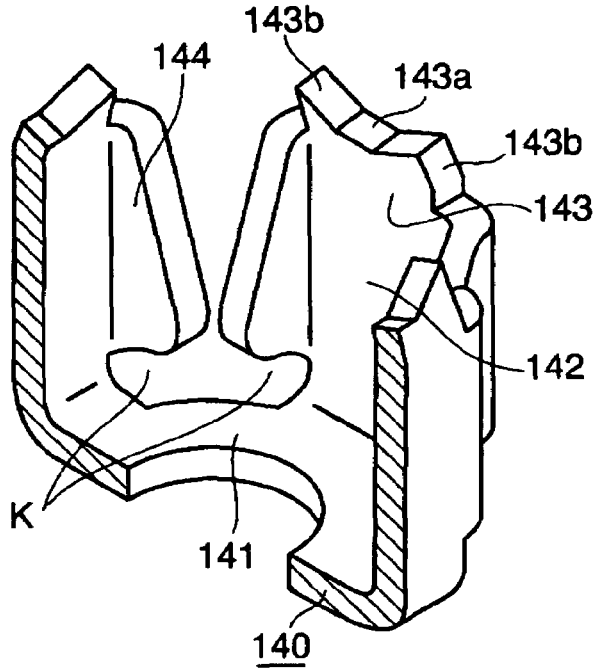
FIG. 2 is a partially cross sectional perspective view showing a leg washer assembled in the vehicle roof antenna mounting assembly according to the invention.

The leg washer 140 is formed by a pressing process after metal, e.g., low-carbon steel is punched. The leg washer 140 has a plate washer ring 141 and four plate leg portions 142 extendedly provided from the washer ring 141. The leg portions 142 are disposed corresponding to the notches 122, 123 described above, respectively. A diameter of a peripheral shape formed by the leg portions 142 is made as slightly smaller than an inner diameter of the mounting hole RH described above. As shown in FIG. 2, a tip portion 143 of each of the leg portions 142 is formed to be somewhat bended inwardly, and has a flat portion 143*a* formed linearly and claw portions 143*b* disposed on both ends thereof.

A taper portion 144 is extendedly provided on a side surface of each of the leg portions 142. The taper portion 144 is formed as opposed to the edge portion 125 so that an inner diameter formed by the taper portions expands from the washer ring 141 side to the tip portion 143 side. That is, the taper portion 144 is tapered from the washer ring side to the tip portion side. The taper portion 144 is abutted on the edge portion 125, and designed such that an inner diameter formed by the tip portions 143 is gradually expanded as contrasted with the leg portion 142, that is, the tip portions is gradually expanded from the original position of the leg portion 142 toward an outside of the mounting hole RH by tightening the bolt 160. The taper portion 144 is also formed to have a little space K spaced with the washer ring 141.

Figure 3:
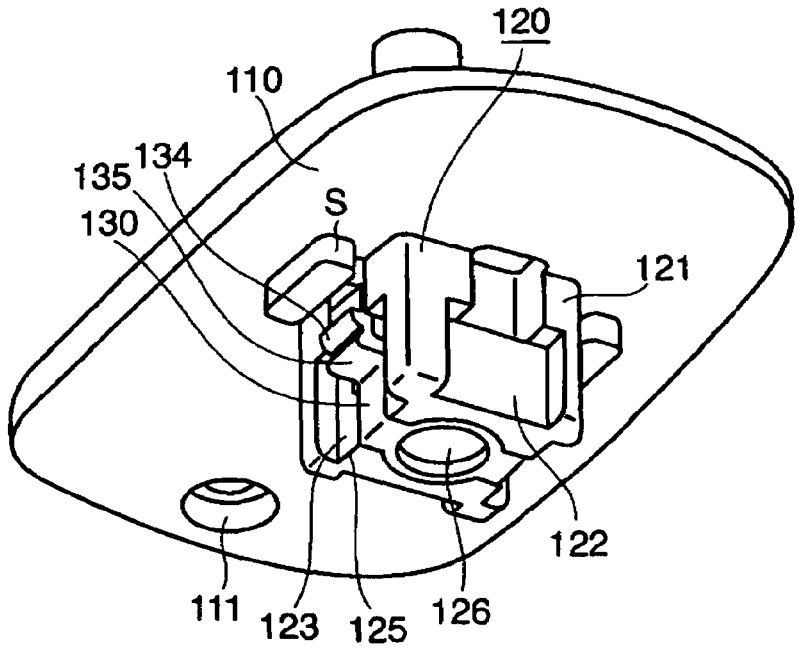
FIG. 3 is a perspective view showing a condition where a temporary joint member is attached to a convex portion of an antenna base assembled in the vehicle roof antenna mounting assembly according to the invention.

Next, an operation for mounting the vehicle roof antenna mounting assembly 100 to the vehicle roof panel R is explained hereunder. First of all, as shown in FIG. 3, the temporary joint member 130 is assembled to the convex portion 120. The leg washer 140 and the plate washer 150 are then assembled by the bolt 160 screwed lightly.

Figure 4:
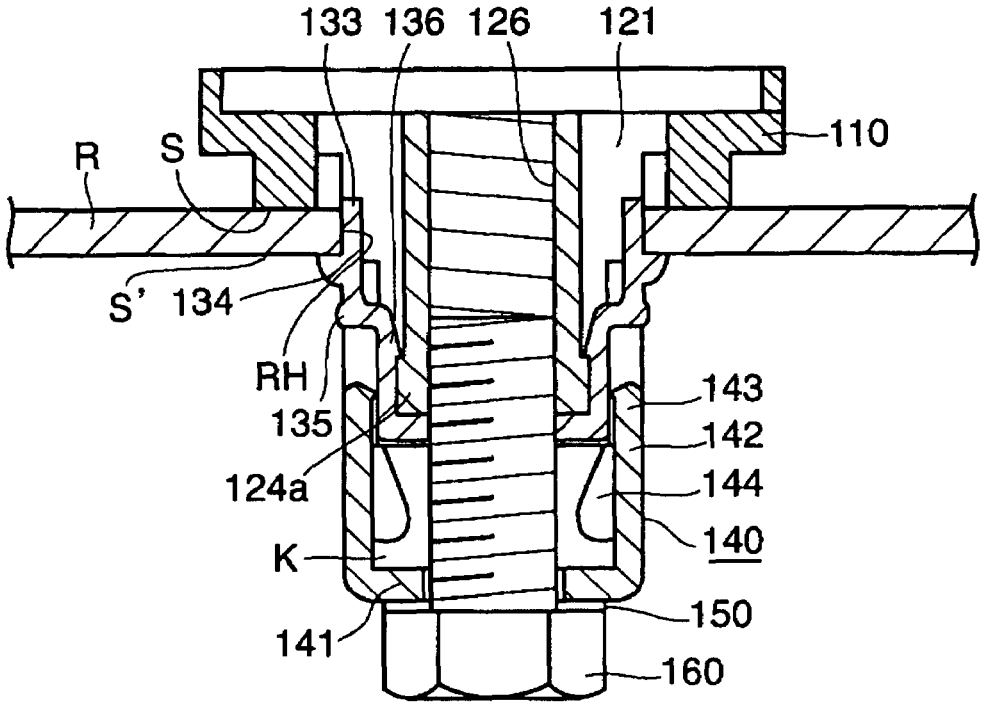
FIG. 4 is a longitudinal sectional view showing a condition where the vehicle roof antenna mounting assembly is tightened temporarily to a vehicle roof panel according to the invention.

In this condition, the convex portion 120 is inserted into the mounting hole RH from the upper side of the vehicle roof panel R as shown in FIG. 4. At this time, since the tip of the leg portion 142 of the leg washer 140 is fitted into each of the notches 122, 122, 123, 123, there is no obstacle to insert the convex portion into the mounting hole RH. Though the fastening portion 134 of the temporary joint member 130 is projected to the outside of the mounting hole RH, it can be inserted through the mounting hole RH because the joint leg 132 has enough elasticity. That is, when the temporary joint member 130 is inserted into mounting hole RH, the joint leg 132 is flexed temporarily to the inside with some loads. When the fastening portion 134 is passed completely through the mounting hole RH, the joint leg 132 is returned to the original state with elasticity, and then the fastening portion 134 is again projected to the outside of the mounting hole RH.

The convex portion 120 is jointed temporarily to the vehicle roof panel R when the fastening portion 134 is projected. Thus, the antenna base 110 cannot be removed from the vehicle roof panel R unless an operator pinches the fastening portion 134 of the temporary joint member 130 to push it out from a vehicle interior. Also, since the release knob 135 is provided on each of the joint legs, even if the antenna base 110 has to be removed because of component replacement, the temporary joint member 130 can easily be removed by pinching the release knobs 135 from both sides to release the fastening portion 134 from the vehicle roof panel R after removing the leg washer 140 by loosening the bolt 160.

Next, where the operator tightens the bolt 160 from the vehicle interior, a shaft length of the bolt 160 to the antenna base 110 is shortened, so that whole of the leg washer 140 is pressed toward the vehicle roof panel R.

Figure 5:
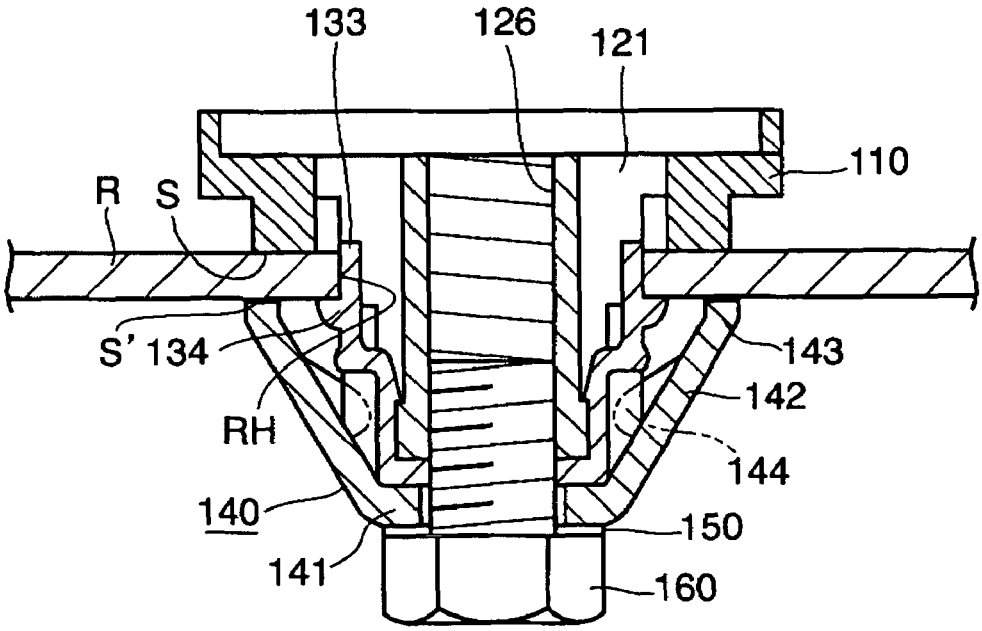
FIG. 5 is a longitudinal sectional view showing a condition where the vehicle roof antenna mounting assembly is tightened completely according to the invention.

In this condition, the inner face of the taper portion 144 formed on each of the leg portions 142, 142 of the leg washer 140 is particularly abutted on the edge portion 125 of the convex portion 120. Therefore, the inner diameter formed by the tip portions 143 is gradually expanded while the bolt 160 is tightened. That is, the tip portions 143 are expanded toward an outside of the mounting hole RH. As a result, as shown in FIG. 5, a space between the tip portions 143, 143 is more expanded than the inner diameter of the mounting hole RH. The tip portion 143 is also abutted on the vehicle roof panel R from the vehicle interior side at an abutted position S' as shown in FIG. 5.

In this condition, since the tip portion 143 of the leg portion 142 is bended inwardly to the leg portion 142, the tip portion 143 is perpendicularly abutted on the abutted position S' of the vehicle roof panel R when the leg portions are expanded. The roof panel R is not deformed owing to the abutting of the tip portions 143, because there is the abutted portion S of the antenna base 110 on the outside of the roof panel R and the roof panel R is sandwiched on both sides thereof by the abutted portion S' of tip portions 143 and the abutted portion S of the antenna base 110. Also, since the space K is provided, there is no force from the edge portion 125 to the taper portion 144 for expanding the leg portions 142 in a condition where the tightening member is tightened completely. Therefore, tightening force to the bolt 160 becomes tremendous pressing force to the vehicle roof panel R for the tip portion 143 in a perpendicular direction, so that electrical connectivity between the tip portion 143 and the vehicle roof panel R can be made certain.

Further, since the tip portion 143 is provided with the flat portion 143*a* with an enough width, a contact region can be made large. Also, since the claw portions 143*b* are made sharp, the claw portions bite into the vehicle roof panel R strongly.

Therefore, even if the abutted position S' on the bottom surface of the vehicle roof panel R is coated by paint, etc., and the leg washer 140 is intended for using as an electrical transmission line such as a grounding for one part of the antenna, it is possible to electrically connect to the vehicle roof panel R certainly to prevent a contact failure.

As explained above, the present vehicle roof antenna mounting assembly 100 can be mounted by an extremely easy operation in which the protruding bolt 160 is only tightened from the vehicle interior after jointing temporarily. Moreover, since the bolt 160 is assembled into the antenna base 110 in advance, there is no possibility that the nut falls out toward the vehicle interior, so that the mounting assembly according to the present invention can reduce the operator's burden greatly.

The leg portions 142 are formed to be in parallel with each other at first, and are expanded to be tightened to the convex portion. The leg portion 142 is therefore fixed strongly to the convex portion 120 with its elastic force, and also has an effect of preventing slacking of the bolt. Furthermore, the edge portion 125 and the taper portion 144 are in friction with each other, the fixing force is made stronger.

The mounting assembly in which the taper portion is provided on the leg washer side can be made smaller than that is provided on the convex portion side. The reason for that is explained with reference to FIGS. 6 and 7. It is explained using a comparison example of a vehicle roof antenna mounting assembly H in which the taper portion is provided on the convex portion side. The vehicle roof antenna mounting assembly H includes a convex portion T, a leg washer Q and a bolt B. The convex portion T includes an internal threaded hole Ta and a taper portion Tb. In the figures, a symbol S' depicts a position of the leg washer Q to be abutted on the vehicle roof panel R. The diameters of the bolt 160 and the bolt B, and the abutted positions S' are the same as each other, respectively.

It is necessary to have a minimum wall thickness t of each of the convex portion 120 and the convex portion T screwed by the bolt 160 and the bolt B respectively for ensuring strength during the screwing. For ensuring the minimum wall thickness t, the convex portion T of the comparison example should be designed such that a minimum outer diameter portion of the taper portion Tb has at least the wall thickness t. Therefore, it is necessary to be designed such that the outer diameter of the convex portion T becomes gradually large from the wall thickness t. As compared thereto, since there is no taper portion on the convex portion 120 of the embodiment, there is no need to enlarge the outer diameter of the convex portion 120 as long as the minimum wall thickness t is ensured.

Figure 6:
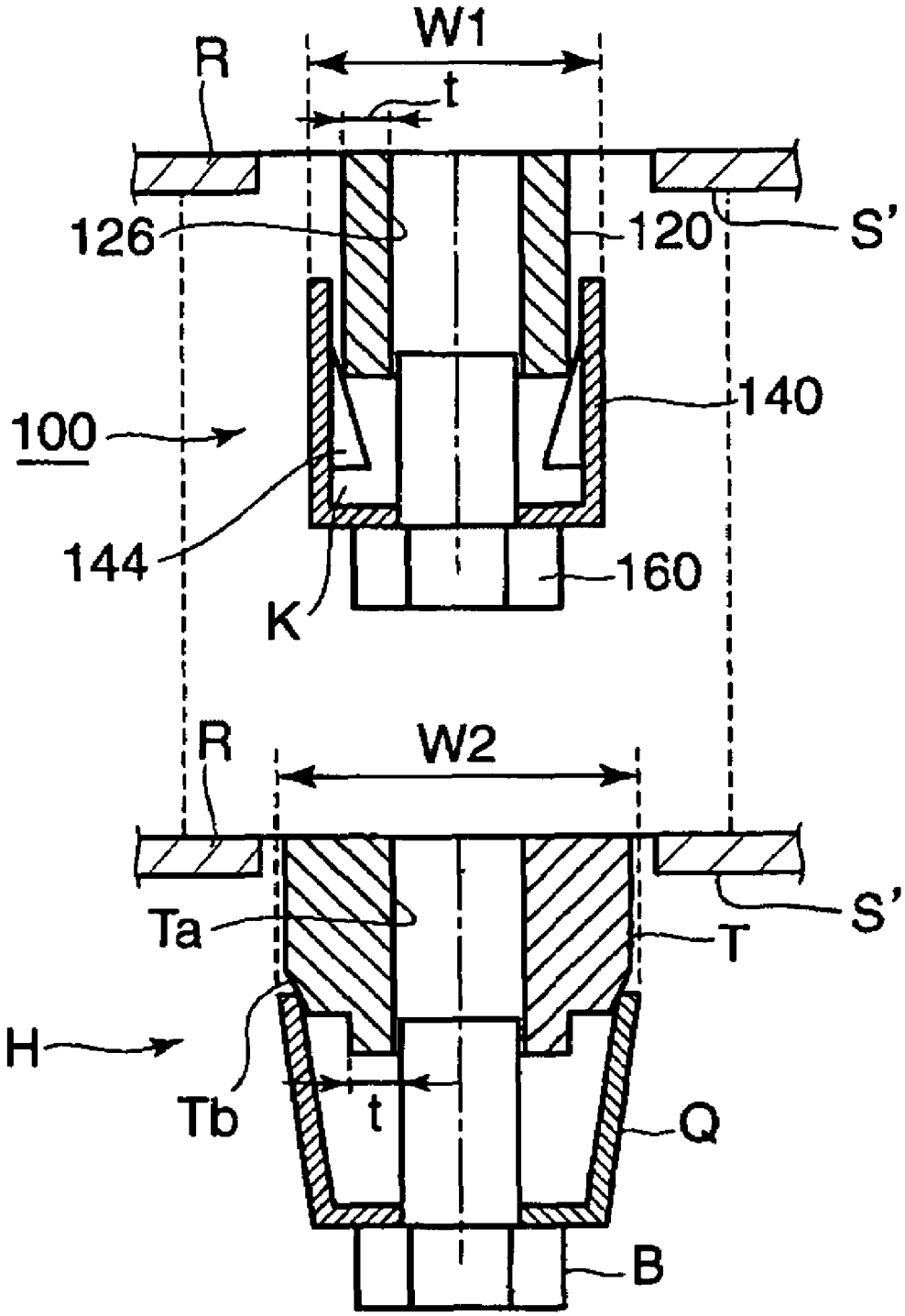
FIG. 6 is a longitudinal sectional view showing a condition before tightening a screw for explaining a miniaturization principle of the vehicle roof antenna mounting assembly according to the invention.
Figure 7:
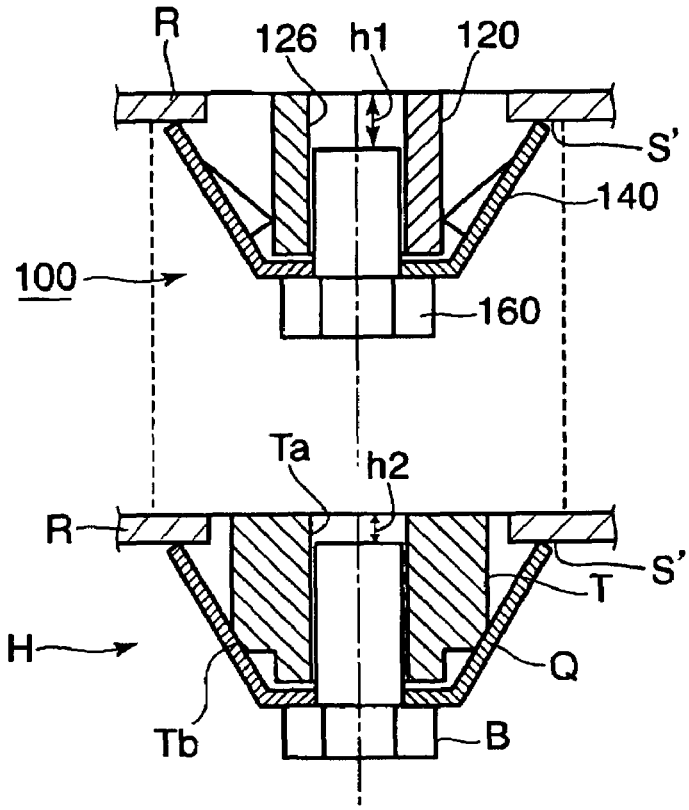
FIG. 7 is a longitudinal sectional view showing a condition after tightening a screw for explaining a miniaturization principle of the vehicle roof antenna mounting assembly according to the invention.

For the above reason, as shown in FIG. 6, a maximum outer diameter of the convex portion T of the comparison example is larger than that of the convex portion 120 of the embodiment. Accordingly, the maximum diameter W2 of the leg washer Q is also larger than that W1 of the leg washer 140. On the other hand, since the distance from the central axis of the leg washer 140 to the taper portion 144 is shorter than that from the central axis of the leg washer Q to the taper portion Tb, an amount to be tightened to the abutted position S' during the expanding of the leg portions becomes smaller than that in the comparison example as shown in FIG. 7. That is, the distance h1 is larger than that h2. Thus, a height of the convex portion 120 can be made shorter than that of the convex portion T. Therefore, the vehicle roof antenna mounting assembly 100 can be made smaller than the vehicle roof antenna mounting assembly H of the comparison example.

In the above embodiment, the leg portions 142 of the leg washer 140 are four legs, but are not limited thereto, and the leg portions 142 may even be three legs or five legs or more. Though the convex body 121 of the convex portion 120 is in a quadrangular cylinder shape, it may also be in a cylinder shape such as a circular cylinder shape, a triangular cylinder shape and a hexagonal cylinder shape. The plate washer 150 uniformly provides the tightening force of the bolt 160 to the leg washer 140, and has an effect of preventing slacking of the bolt. However, it is not limited thereto, and the plate washer 150 may be omitted by providing the leg washer 140 with the effect thereof. Further, though the leg washer 140 and the temporary joint member 130 are separated with each other in the above embodiment, it may be made as one body.

Figure 8:
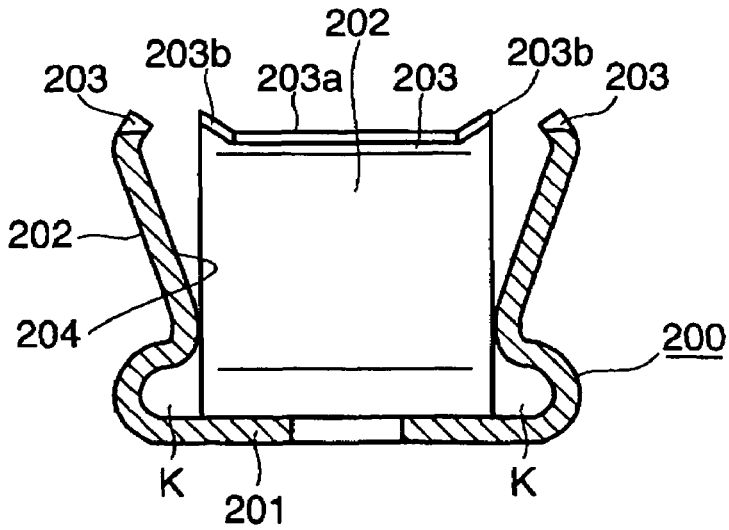
FIG. 8 is a longitudinal sectional view showing a modified example of the leg washer assembled in the vehicle roof antenna mounting assembly according to the invention.

FIG. 8 shows a longitudinal sectional view of a leg washer 200 as a modified example of the leg washer 140 assembled into the above vehicle roof antenna mounting assembly 100 according to a second embodiment of the invention.

The leg washer 200 includes a plate washer ring 201 and four plate leg portions 202. The washer ring 201 has an opening to pass the bolt 160 therethrough at the center thereof. The leg portions 202 are extendedly provided from the washer ring 201. The leg washer 200 is formed by a pressing process after metal, e.g., low-carbon steel is punched.

The leg portions 202 are formed to be disposed corresponding to the above notches 122, 123, respectively. The tip portion 203 of each of the leg portions 202 is formed to be somewhat bended inwardly. The tip portion 203 has a flat portion 203*a* formed linearly and claw portions 203*b* disposed on both ends thereof. As shown in FIG. 8, each of the leg portions 202 is bended inwardly to form a taper face 204. The taper face 204 is provided as opposed to each of the edge portions 125, and is formed such that an inner diameter formed by the leg portions is expanded from the washer ring 201 side to the tip portion 203 side. That is, the taper face 204 is abutted on the edge portion 125, and designed such that a force is provided to a direction in which the tip portions 203 are gradually expanded as contrasted with each of the leg portions 202. The taper face 204 is also formed to have a little space K spaced with the washer ring 201.

The operation for mounting the vehicle roof antenna mounting assembly 100 on the vehicle roof panel R using the leg washer 200 according to the modified example is the same as that using the leg washer 140 of the first embodiment. For the leg washer 200, when the bolt 160 is screwed, the taper face 204 of each of the leg portions 202 is abutted on each the edge portions 125, so that the leg portions 202 are opened with each other.

In the second embodiment as well as the first embodiment of the invention, since the vehicle roof antenna mounting assembly can easily be mounted temporarily, and can be fixed only by an extremely easy operation in which the protruding bolt 160 is only tightened from the vehicle interior, operator's burden can greatly be reduced.

While the invention has been described in its preferred embodiments, it is to be understood that the words which have been used are words of description rather than limitation and that changes within the purview of the appended claims may be made without departing from the true scope of the invention as defined by the claims. For example, in the above embodiments, the internal threaded hole as the first screw is provided to the convex portion 120 side and the external screw as the second screw is provided to the bolt 160 side. However, the external screw as the first screw may be provided to the convex portion 120 side and the leg washer 140 may be threaded by the nut with the internal threaded hole as the second screw.

What is claimed is:

1. A vehicle roof antenna mounting assembly fixed by inserting a part of the mounting assembly from an outside of a vehicle through a mounting hole formed through a vehicle roof panel so as to engage the vehicle roof panel, the mounting assembly comprising:

an antenna base disposed on an outside surface of said vehicle roof panel of said vehicle;

a convex portion formed on a surface of the vehicle roof panel side of said antenna base, said convex portion being inserted into said mounting hole, said convex portion having a surface portion defining a threaded screw recess, said surface portion having an edge portion;

a tightening member having a threaded screw portion said tightening member being tightened to said convex portion such that said threaded screw recess receives said threaded screw portion of said tightening member;

a leg washer having a plate washer ring, said plate washer ring body defining a plate washer ring hole, said threaded screw portion of said tightening member extending through said plate washer ring hole, said leg washer having a leg portion extending from said plate washer ring toward said mounting hole, said leg washer having a tapered portion connected to said leg portion, said tapered portion being located opposite said edge portion of said surface portion, said tapered portion engaging said edge portion such that a tip portion of said leg portion expands in a direction opposite said mounting hole when said tightening member is tightened, whereby said plate washer ring is opposite said mounting hole when said tightening member has been tightened.

2. The vehicle roof antenna mounting assembly according to claim 1, wherein said leg portion is formed flatly, and said tapered portion extends on a side of said leg portion.

3. The vehicle roof antenna mounting assembly according to claim 1, wherein said tapered portion is formed by bending at least a part of said leg portion inwardly.

4. The vehicle roof antenna mounting assembly according to claim 3, wherein said tapered portion is a tapered face of said bent leg portion.

5. The vehicle roof antenna mounting assembly according to claim 1, wherein said tapered portion is formed such that said tapered portion can be released from being in contact with said edge portion when said tightening member is completely tightened to said convex portion.

6. The vehicle roof antenna mounting assembly according to claim 1, wherein said tip portion is bent such that said tip portion is perpendicular to an inside vehicle surface of said vehicle roof panel when said tightening member is completely tightened to said convex portion, whereby said perpendicular tip portion engages an inside vehicle surface of said vehicle roof panel.

7. The vehicle roof antenna mounting assembly according to claim 1, further comprising a temporary joint member located between said convex portion and said leg washer, said temporary joint member comprising:

a support member located between said convex portion and said washer ring;

an elastic temporary joint leg having a toe portion and an arm portion, said joint leg extending from said support member toward said mounting hole, wherein a portion of said toe portion is disposed outside of said vehicle roof panel when said vehicle roof antenna mounting assembly is mounted; and a fastening portion formed between said toe portion and said arm portion such that a portion of said fastening portion is disposed on the outside of said mounting hole, whereby said fastening portion engages an inside surface of said vehicle roof panel.

8. An antenna attachment assembly for attaching an antenna to a panel of a vehicle, the attachment assembly comprising:

a vehicle panel, said vehicle panel defining a mounting hole, said vehicle panel having an outside vehicle surface and an inside vehicle surface;

a base assembly having a vehicle roof panel surface in contact with said outside vehicle surface;

a retaining mount connected to said vehicle roof panel surface of said base assembly, said retaining mount extending through said mounting hole of said vehicle panel, said retaining mount having a surface portion defining an internal threaded screw groove, said retaining mount having a plurality of outside edge portions;

a fixing member having a threaded screw portion, said fixing member being connected to said retaining mount such that said threaded screw portion of said fixing member engages said internal threaded screw groove of said retaining mount;

an expandable member having an annular portion, said annular portion defining an expandable member recess, said expandable member recess being aligned with said internal threaded screw groove, said threaded screw portion of said fixing member extending through said expandable member recess, said expandable member having a plurality of expandable member portions, each expandable member portion being connected to said annular portion, said expandable member having a plurality of tapered expandable member portions, each tapered expandable member portion being connected to one of said expandable member portions, each tapered expandable member portion being located opposite one of said outside edge portions, one of said tapered expandable member portions being in contact with one of said outside edge portions such that an end portion of each expandable member portion expands in a direction opposite said mounting hole as said fixing member is connected to said retaining mount, whereby each said expandable member portion engages said inside vehicle surface of said vehicle panel.

9. The antenna attachment assembly according to claim 8, wherein each said expandable member portion is formed flatly, each said tapered expandable member portion extending on each side of each expandable member portion such that each tapered expandable member portion is perpendicular to each expandable member portion.

10. The antenna attachment assembly according to claim 8, wherein each said tapered expandable member portion is formed by bending at least a part of each expandable member portion inwardly.

11. The vehicle roof antenna mounting assembly according to claim 10, wherein said tapered expandable member portion is a tapered face of said bent leg portion.

12. The antenna attachment assembly according to claim 8, wherein each said tapered expandable member portion is formed such that each said tapered expandable member portion can be detached from one of said outside edge portions when said fixing member is completely connected to said retaining mount.

13. The antenna attachment assembly according to claim 8, wherein said end portion of each tapered expandable member portion is bent such that said end portion is perpendicular to said inside vehicle surface of said vehicle roof panel when said fixing member is completely connected to said retaining mount, whereby said perpendicular end portion of each tapered expandable member portion engages said inside vehicle surface of said vehicle roof panel.

14. The antenna attachment assembly according to claim 8, further comprising a temporary joint member positioned between said retaining mount and said expandable member, said temporary joint member comprising:

a support member located between said retaining mount and said annular portion of said expandable member;

an elastic temporary joint leg having a toe portion and an arm portion, said joint leg being connected to said support member and extending toward said mounting hole, wherein a portion of said toe portion is disposed at a location outside of said vehicle roof panel when said antenna attachment assembly is mounted; and a fastening portion formed between said toe portion and said arm portion such that said a portion of said fastening portion is disposed on the outside of said mounting hole, whereby said fastening portion engages said inside vehicle surface of said vehicle roof panel.

15. An attachment assembly for attaching an antenna to a panel of a vehicle, the attachment assembly comprising:

a vehicle panel having a defined mounting hole, said vehicle panel having an outside vehicle surface and an inside vehicle surface;

an antenna base assembly having a vehicle roof panel surface, said vehicle roof panel surface engaging said outside vehicle surface;

an attachment element integrally connected to said vehicle roof panel surface of said antenna base assembly, said attachment element extending through said mounting hole of said vehicle panel, said attachment element having a surface portion defining a connecting member recess, said attachment element having a plurality of external edge portions;

a connecting member detachably connected to said attachment element such that said connecting member recess receives said connecting member from a vehicle interior side;

an expandable member having an annular portion, said annular portion defining an expandable member recess, said expandable member recess being aligned with said connecting member receiving recess, said connecting member extending through said expandable member recess, said expandable member having a plurality of retaining portions, each retaining portion being connected to said annular portion, said expandable member having a plurality of tapered portions, each tapered portion being connected to one of said retaining portions, each tapered portion being located opposite one of said external edge portions, each said tapered portion being in contact with one of said external edge portions such that an end portion of each retaining portion expands in a direction opposite said mounting hole as said connecting member is connected to said attachment element, whereby each retaining portion engages said inside vehicle surface of said vehicle panel.

16. The attachment assembly according to claim 15, wherein each said retaining portion is formed flatly, each said tapered portion extending on each side of each retaining portion such that each tapered portion is perpendicular to each retaining portion.

17. The attachment assembly according to claim 15, wherein each said tapered portion is formed by bending at least a part of each retaining portion inwardly, said tapered portion being a tapered face of said bent leg portion.

18. The attachment assembly according to claim 15, wherein each said tapered portion is formed such that each said tapered portion can be detached from one of said external edge portions when said connecting member completely engages said connecting member recess, whereby said connecting member is completely connected to said attachment element.

19. The attachment assembly according to claim 15, wherein said end portion of each tapered portion is bent such that said end portion is perpendicular to said inside vehicle surface of said vehicle roof panel when said connecting member is completely connected to said attachment element, whereby said perpendicular end portion of each tapered portion engages said inside vehicle surface of said vehicle roof panel.

20. The attachment assembly according to claim 15, further comprising a temporary joint member positioned between said attachment element and said expandable member, said temporary joint member comprising:

a support member located between said attachment element and said annular portion of said expandable member;

an elastic temporary joint leg having a toe portion and an arm portion, said joint leg being connected to said support member and extending toward said mounting hole, wherein a portion of said toe portion is disposed at a location outside of said vehicle roof panel when said attachment assembly is mounted to said vehicle roof panel; and a fastening portion formed between said toe portion and said arm portion such that said fastening portion is disposed on the outside of said mounting hole, whereby said fastening portion engages said inside vehicle surface of said vehicle roof panel.

* * * * *